US007712397B2

(12) United States Patent
Hu

(10) Patent No.: US 7,712,397 B2
(45) Date of Patent: May 11, 2010

(54) WRENCH ASSEMBLY

(76) Inventor: Bobby Hu, 16F, No. 367, Section 1, Gong Yi Road, Taichung (TW)

( * ) Notice: Subject to any disclaimer, the term of this patent is extended or adjusted under 35 U.S.C. 154(b) by 0 days.

(21) Appl. No.: 12/114,850

(22) Filed: May 5, 2008

(65) Prior Publication Data

US 2008/0202293 A1 Aug. 28, 2008

Related U.S. Application Data

(63) Continuation-in-part of application No. 11/279,650, filed on Apr. 13, 2006, now abandoned.

(51) Int. Cl.
*B25B 23/16* (2006.01)
*B25B 13/00* (2006.01)

(52) U.S. Cl. ..... 81/177.2; 81/125.1

(58) Field of Classification Search ..... 81/177.2, 81/177.1, 125.1, 124.3, 177.85, 124.1, 177.5, 81/177.7, 180.1, 58.3, 60–63.3
See application file for complete search history.

(56) References Cited

U.S. PATENT DOCUMENTS 3,376,768 A 4/1968 Fortunato ..... 81/177
4,596,167 A 6/1986 White, Jr. ..... 81/177.2
5,295,422 A 3/1994 Chow ..... 81/124.3
5,351,586 A 10/1994 Habermehi et al. ..... 81/438
5,996,448 A 12/1999 Suekage ..... 81/177.2
6,000,299 A 12/1999 Cole ..... 81/60
6,332,382 B1 12/2001 Anderson et al. ..... 81/438
6,601,476 B2 8/2003 Hu ..... 81/177.85
6,701,808 B2 3/2004 Hsieh ..... 81/124.3
7,000,504 B2 2/2006 Chen ..... 81/60

*Primary Examiner*—Hadi Shakeri
(74) *Attorney, Agent, or Firm*—Alan Kamrath; Kamrath & Associates PA

(57) ABSTRACT

A wrench assembly includes a first wrench, a second wrench and a bar. The first wrench includes a first driving device at an end and a second driving device at an opposite end. The second wrench includes a first driving device at an end and a second driving device at an opposite end. The bar includes a first connecting device for connection to the second driving device of the first wrench and a second connecting device for connection to the first driving device of the second wrench. A first C-clip is provided to reinforce the connection of the first connecting device of the bar to the second driving device of the first wrench. A second C-clip is provided to reinforce the connection of the second connecting device of the bar to the first driving device of the second wrench.

22 Claims, 11 Drawing Sheets

WRENCH ASSEMBLY

CROSS REFERENCE

The present application is a continuation-in-part application of U.S. patent application Ser. No. 11/279,650, filed on Apr. 13, 2006, now abandoned, of which the entire disclosure is incorporated herein.

BACKGROUND OF INVENTION

1. Field of Invention

The present invention relates to a wrench assembly.

2. Related Prior Art

U.S. Pat. No. 5,996,448 discloses a socket wrench including a handle 2, extension means 20 and a ratchet head 30. The extension means 20 includes receiving means 22 for receiving a shank 8 of the handle 2 and a shank 24 for insertion in receiving means 32 of the ratchet head 30. The shank 24 is equipped with a spring-loaded detent for abutting an internal face of the receiving means 32. The shank 8 is equipped with a spring-loaded detent for abutting an internal face of the receiving means 22. However, the detents cannot adequately retain the shank 24 within the receiving means 32 and the shank 8 within the receiving means 22. As compensation, the shanks 24 and 8 must be high enough and the receiving means 32 and 22 must be thick enough. Such large dimensions however make it difficult to use the wrench within limited space.

U.S. Pat. No. 5,996,448 discloses a socket wrench including a handle 2, extension means 20 and a ratchet head 30. The extension means 20 includes receiving means 22 for receiving a shank 8 of the handle 2 and a shank 24 for insertion in receiving means 32 of the ratchet head 30. The shank 24 is equipped with a spring-loaded detent for abutting an internal face of the receiving means 32. The shank 8 is equipped with a spring-loaded detent for abutting an internal face of the receiving means 22. However, the detents cannot adequately retain the shank 24 within the receiving means 32 and the shank 8 within the receiving means 22. As compensation, the shanks 24 and 8 must be high enough and the receiving means 32 and 22 must be thick enough. Such large dimensions however make it difficult to use the wrench within limited space.

U.S. Pat. No. 7,000,504 discloses a ratchet wrench 10 including tool members 40 selectively and changeably received in a compartment 13 thereof. The tool member 40 includes a peripheral groove 43 in which a resilient ring member 43 is adapted to locate. The ring member 43 is made of rubber or other synthetic materials so that it can be squeezed. A ratchet wheel 21 is mounted between the compartment 13 and the tool member 40 and includes an inclined surface 27 on an upper portion thereof. In coupling the tool member 40 to the ratchet wrench 10, the ring member 43 is inserted into a hole defined by the ratchet wheel 21 and is squeezed in order to pass through the hole. When the ring member 43 engages the inclined surface 27, the ring member 43 returns to its original cross sectional profiles and the tool member 40 is attached to the ratchet wrench 10. In disengaging the tool member 40 from the ratchet wrench, the process is reversed. While this attachment enables easy and quick engagement of the ratchet wrench 10 and the tool member 40, it nevertheless suffers from some problems. Firstly, since the peripheral groove 43 provides no redundant recessed space into which the ring member 43 is adapted to move during the engagement/disengagement of the tool member 40 and the ratchet wrench 10, the ring member 43 will rub against the ratchet wheel 21 and gradually wears out. Secondly, since the ring member 43 is made of rubber or other synthetic material and is not forced through the ratchet wheel 21 so as to be retained on the terminate edge of the ratchet wheel 21, it has poor efficacy to reinforce connection of the tool member 40 and the ratchet wrench 10. Thus the ring member 43 is easily accidentally disengaged with the inclined surface 27. Thirdly, the ring member 43 is adapted to return to its original shape and engage with the inclined surface 27 when the tool member 40 engages with the ratchet wrench 10. However, the tool member 40 gradually loses grip with the ratchet wrench 10 as the ring member 43 wears out.

The present invention is therefore intended to obviate or at least alleviate the problems encountered in the prior art.

SUMMARY OF INVENTION

According to the present invention, the wrench assembly includes a first wrench, a second wrench and a bar. The first wrench includes a first driving device at an end and a second driving device at an opposite end. The second wrench includes a first driving device at an end and a second driving device at an opposite end. The bar includes a first connecting device for connection to the second driving device of the first wrench and a second connecting device for connection to the first driving device of the second wrench. The first connecting device includes a first annular groove spaced from the bar greater than a thickness of the second driving device of the first wrench. The second connecting device includes a second annular groove spaced from the bar greater than a thickness of the first driving device of the second wrench.

A first C-clip is compressible and has a first extent parallel to and at least equal to a depth of the first annular groove when the first C-clip is received in the first annular groove. Further, the first C-clip has an outer diameter located outwardly of the first annular groove and an inner diameter located within the first annular groove when the first C-clip is in an expanded condition. The first C-clip is adapted to reinforce the connection of the first connecting device of the bar to the second driving device of the first wrench.

A second C-clip is compressible and has a second extent parallel to and at least equal to a depth of the second annular groove when the second C-clip is received in the second annular groove. Further, the second C-clip has an outer diameter located outwardly of the second annular groove and an inner diameter located within the second annular groove when the second C-clip is in an expanded condition. The second C-clip is adapted to reinforce the connection of the second connecting device of the bar to the first driving device of the second wrench.

Preferably, the first and the second C-clips are made of metal and have a circular cross-sectional profile.

An advantage of the wrench assembly of the present invention is that the C-clips ensure adequate connection of the first and second wrenches to the bar.

An advantage of the wrench assembly of the present invention is that the first and second wrenches and the bar are thin and easily operable within limited space, since the interconnection is ensured.

Other advantages and features of the present invention will become apparent from the following description referring to the drawings.

BRIEF DESCRIPTION OF DRAWINGS

The present invention will be described through detailed illustration of four embodiments referring to the drawings.

DETAILED DESCRIPTION OF EMBODIMENTS

Figure 1:
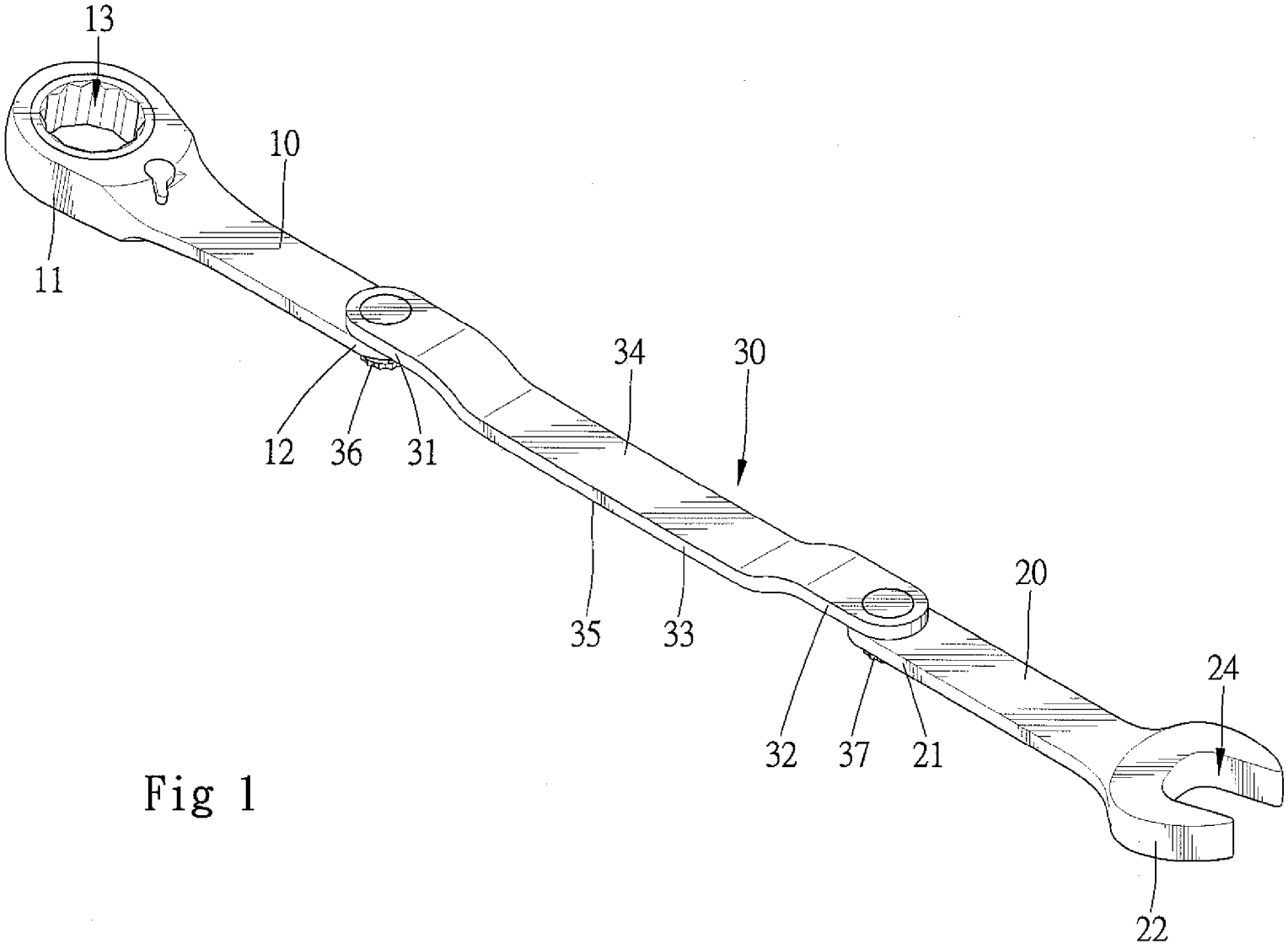
FIG. 1 is a perspective view of a wrench assembly according to the first embodiment of the present invention.
Figure 2:
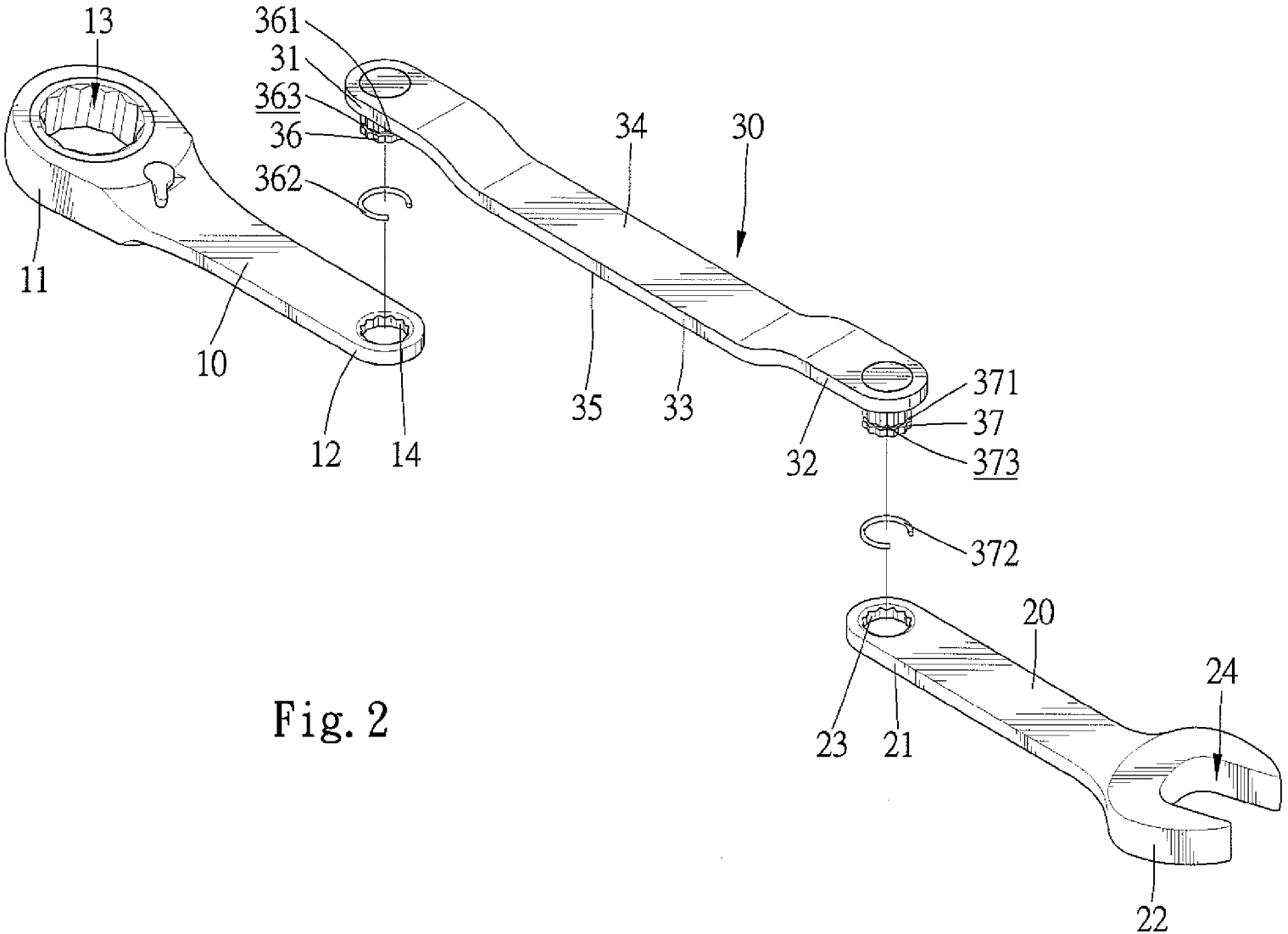
FIG. 2 is an exploded view of the wrench assembly of FIG. 1.
Figure 3:
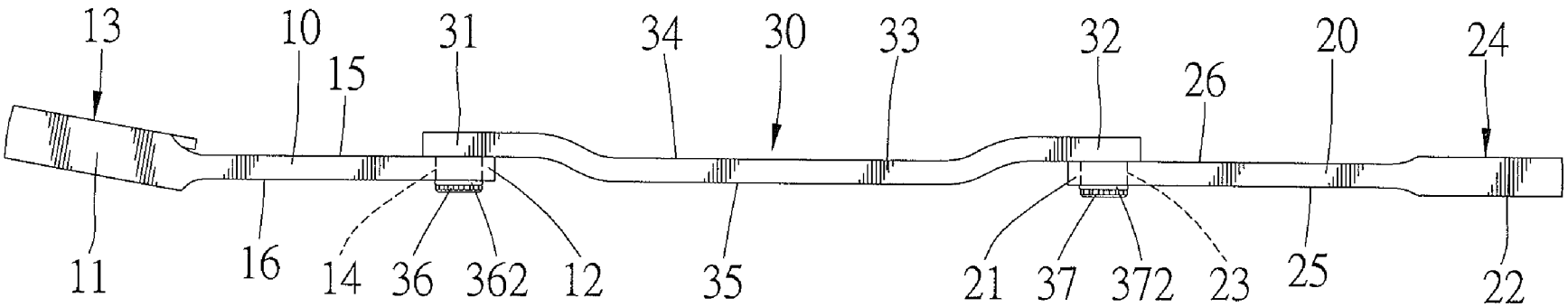
FIG. 3 is a side view of the wrench assembly of FIG. 1.

Referring to FIGS. 1-3, a wrench assembly is shown according to a first embodiment of the present invention. The assembly includes a first wrench 10, a second wrench 20 and a bar 30.

The first wrench 10 includes a first driving device 13 at a first end 11 and a second driving device 14 at a second end 12. The first driving device 13 is preferably a selective one-way driving device. The second driving device 14 is preferably a box end. The first wrench 10 further includes an upper surface 15 and a lower surface 16 spaced from the upper surface 15. The second driving device 14 has a thickness substantially equal to the spacing between the upper and lower surfaces 15 and 16.

The second wrench 20 includes a first driving device 23 formed at a first end 21 and a second driving device 24 formed at a second end 22. The first driving device 23 is preferably a box end. The second driving device 24 is preferably an open end. The second wrench 20 further includes an upper surface 26 and a lower surface 25 spaced from the upper surface 26. The first driving device 23 has a thickness substantially equal to the spacing between the upper and lower surfaces 26 and 25.

The bar 30 includes a first end 31, a second end 32 and a middle section 33 between the ends 31 and 32. An upper surface 34 of the middle section 33 and lower surfaces 35 of the ends 31 and 32 are substantially in the same plane. The bar 30 further includes a first connecting device 36 on the lower surface 35 of the first end 31 and a second connecting device 37 on the lower surface 35 of the second end 32. The first connecting device 36 is preferably a toothed stud defining a first annular groove 361 for receiving a first C-clip 362. The second connecting device 37 is preferably a toothed stud defining a second annular groove 371 for receiving a second C-clip 372. The C-clips 362 and 372 are preferably made of metal and include a circular cross-sectional profile.

As shown in the figures, the first and second annular grooves 361 and 371 define a first space 363 and a second space 373, respectively. The first space 363 and the second space 373 have a first depth and a second depth, respectively. Also, the first annular groove 361 is spaced from the lower surface 35 of the first end 31 greater than the thickness of the second driving device 14 of the first wrench 10 and the second annular groove 371 is spaced from the lower surface 35 of the second end 31 greater than the thickness of the second driving device 14 of the first wrench 10.

Figure 4A:
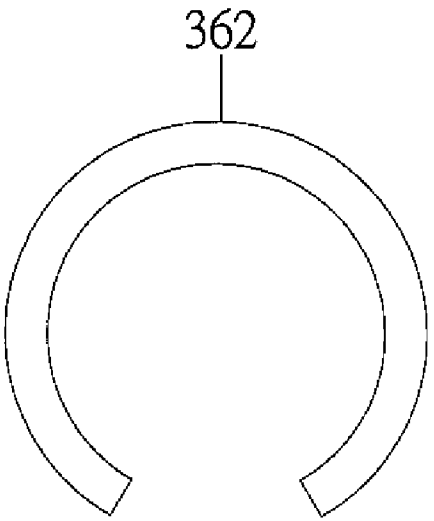
FIG. 4A is a top view of a C-clip shown in FIG. 4.
Figure 4:
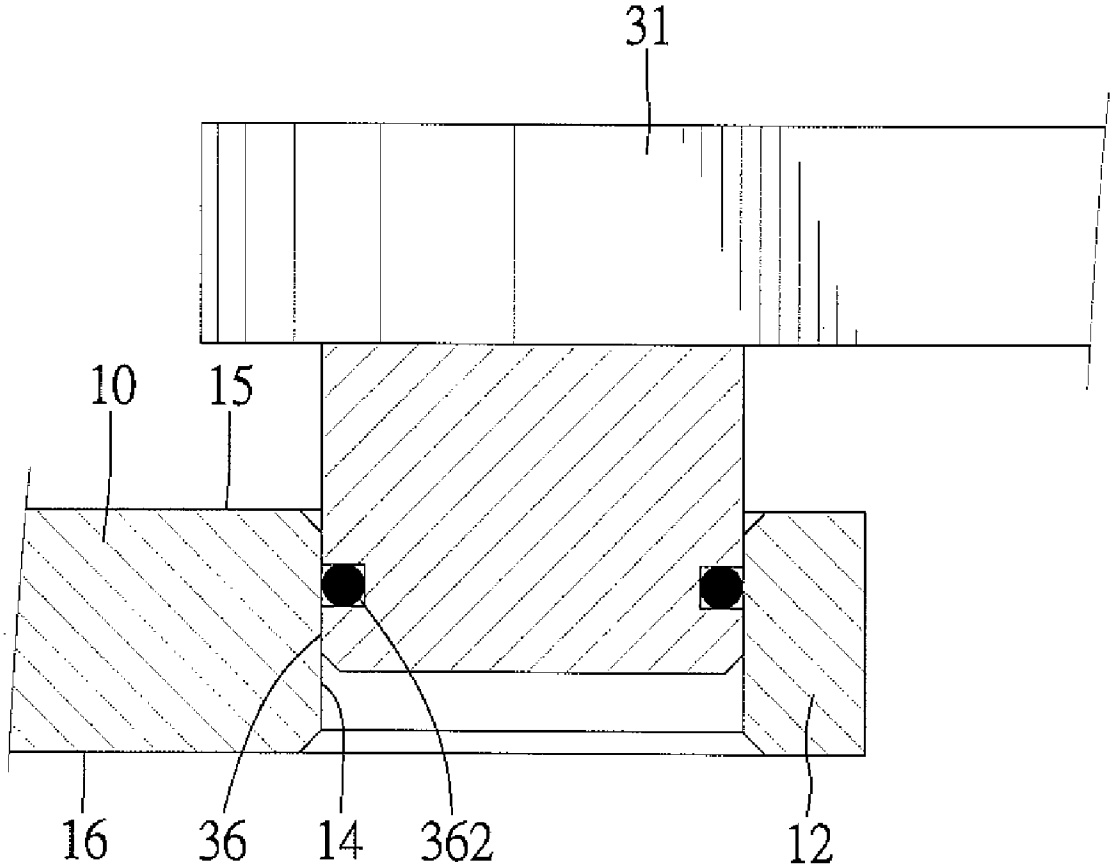
FIG. 4 is an enlarged partial side view, partially in section of the wrench assembly shown in FIG. 3.
Figure 5A:
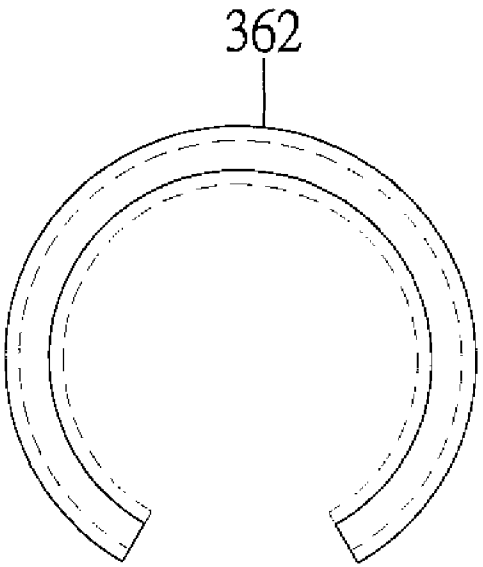
FIG. 5A is a top view of the C-clip shown in FIG. 5, with the shape of the C-clip in FIG. 4A shown in phantom.
Figure 5:
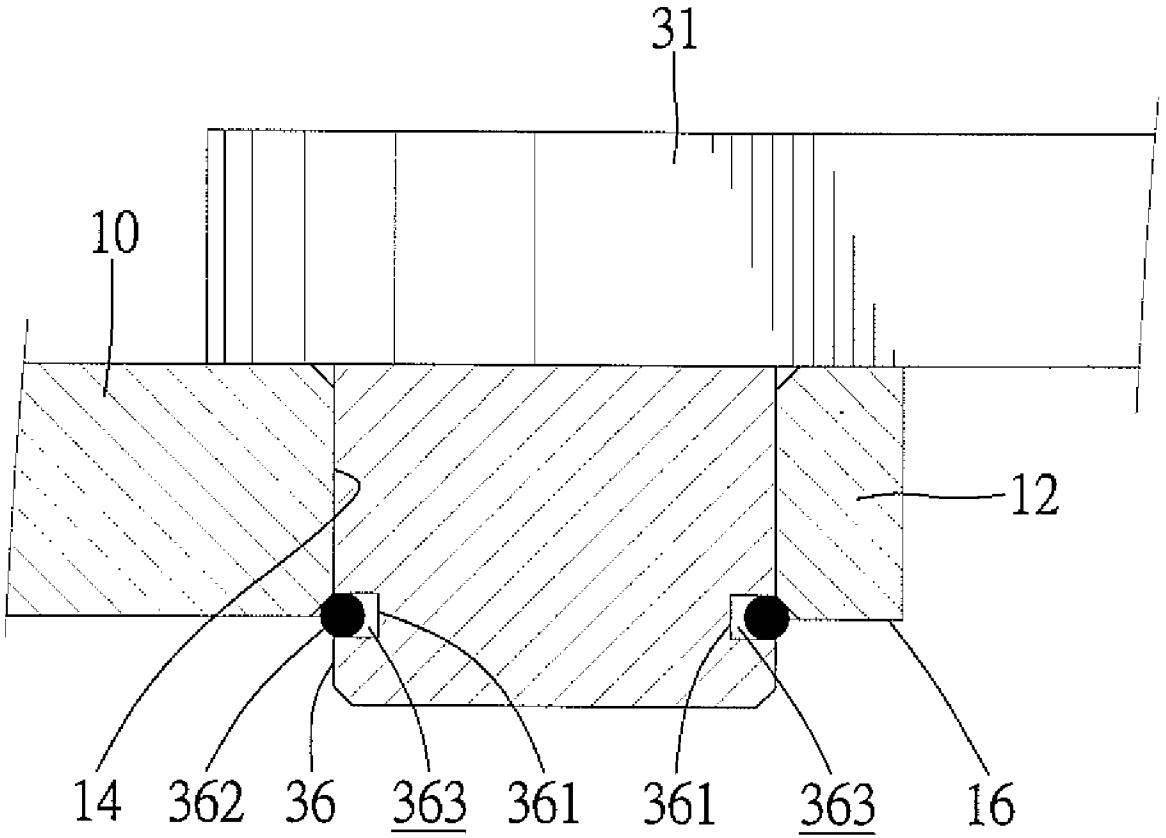
FIG. 5 is another enlarged partial side view, partially in section of the wrench assembly shown in FIG. 3.

Referring to FIGS. 4 through 5, the first C-clip 362 is compressible and has a first extent parallel to and at least equal to the first depth when the first C-clip 362 is received in the first annular groove 361. The first C-clip 362 has an outer diameter located outwardly of the first annular groove 361 and an inner diameter located within the first annular groove 361 when the first C-clip 362 is in an expanded condition. Please note, although not illustrated, but it is understood that the second C-clip 372 has a second extent parallel to and at least equal to the second depth when the second C-clip 372 is received in the second annular groove 371. The second C-clip 372 has an outer diameter located outwardly of the second annular groove 371 and an inner diameter located within the second annular groove 371 when the second C-clip 372 is in an expanded condition.

To connect the first wrench 10 to the bar 30, the first C-clip 362 is first disposed in the first annular groove 361. Then, the first C-clip 362 is forced into the first space 363 of the first annular groove 361 of the first connecting device 36 such that the C-clip 362 is completely received by the first annular groove 361 and thereby prevents abrasion between the first C-clip 362 and the second driving device 14 of the first wrench 10. After the first C-clip 362 passes through the second driving device 14 of the first wrench 10, the first C-clip 362 is in an expanded condition to securely reinforce connection of the first connecting device 36 of the bar 30 to the second driving device 14 of the first wrench 10. Likewise, as for securely connecting the second wrench 20 to the bar 30, the second C-clip 372 is first disposed in the second annular groove 371. Then, the second C-clip 372 is forced into the second space 373 of the second annular groove 371 of the second connecting device 37 such that the second C-clip 372 is completely received by the second annular groove 371 and thereby prevents abrasion between the second C-clip 372 and the first driving device 23 of the second wrench 20. When the second C-clip 372 passes through the first driving device 23 of the second wrench 20, the second C-clip 372 is in an expanded condition to securely reinforce connection of the second connecting device 37 of the bar 30 to the first driving device 23 of the second wrench 20. In disengaging the first wrench 10 and/or the second wrench 20 from the bar 30, the processes are reversed.

In this embodiment, the cross-sectional profile of the first C-clip 362 and the second C-clip 372 can remain circular and undeformed when being forced through the second driving device 14 of the first wrench 10 and first driving device 23 of the second wrench 20, respectively. Also, when the first wrench 10 and the second wrench 20 are locked to the bar 30, the first and second C-clips 362 and 372 are resiliently biased to their original shape.

Figure 6:
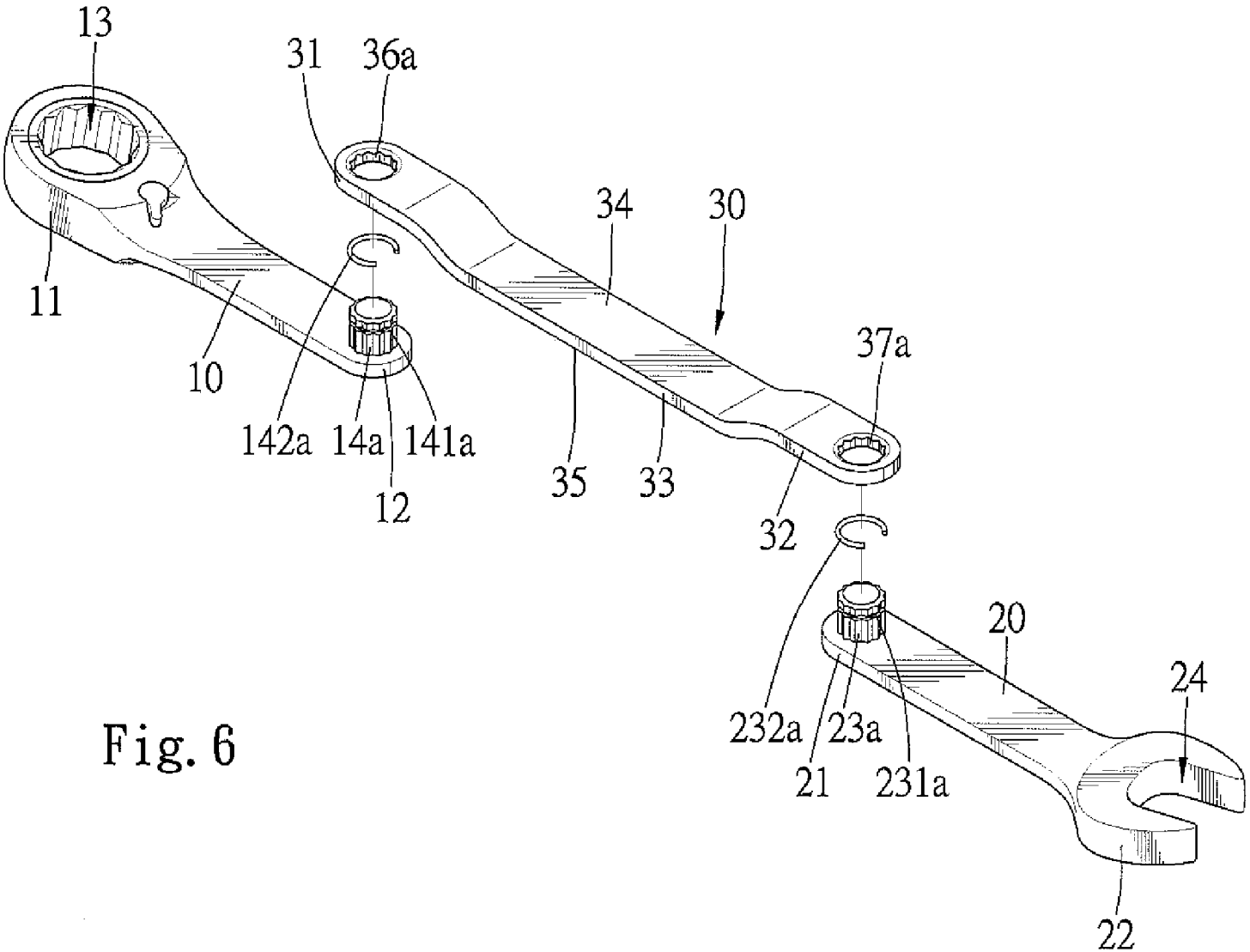
FIG. 6 is an exploded view of a wrench assembly according to a second embodiment of the present invention.
Figure 7:
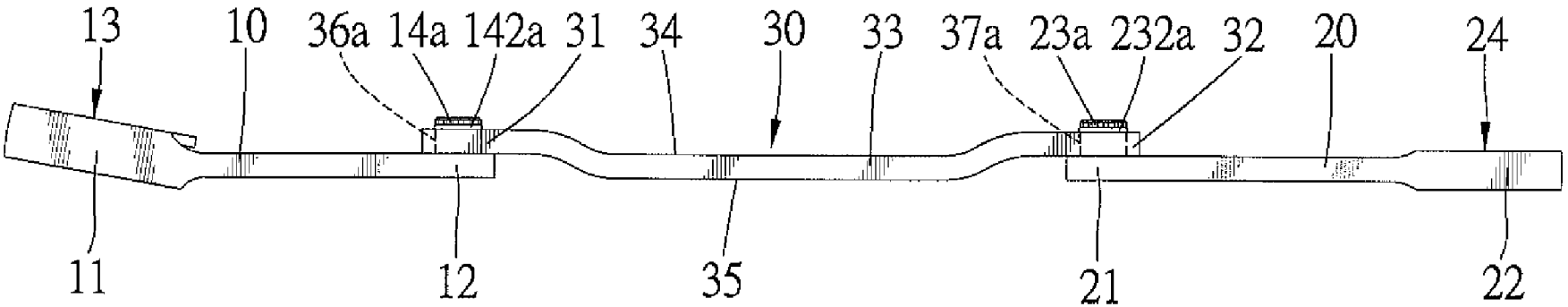
FIG. 7 is a side view of the wrench assembly of FIG. 6.

FIGS. 6 and 7 show a wrench assembly according to a second embodiment of the present invention. The second embodiment is like the first embodiment, except that the first wrench 10 includes a second driving device 14*a*, which is preferably a toothed stud defining an annular groove 141*a* for receiving a C-clip 142*a*. The second wrench 20 includes a first driving device 23*a*, which is preferably a toothed stud defining an annular groove 231*a* for receiving a C-clip 232*a*. Further, the bar 30 includes two connecting devices 36*a* and 37*a*, which are preferably box ends.

Figure 8:
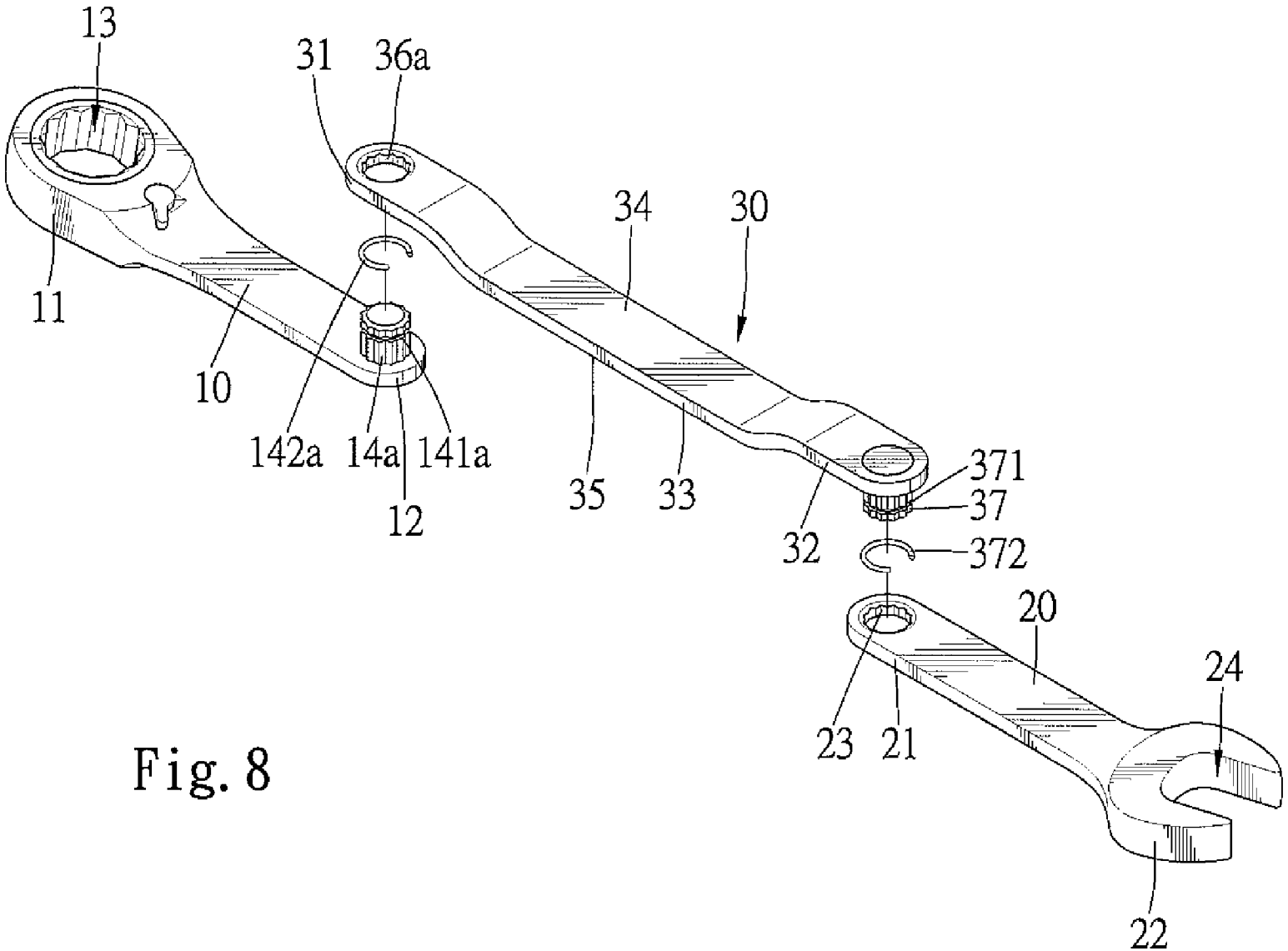
FIG. 8 is an exploded view of a wrench assembly according to a third embodiment of the present invention.
Figure 9:
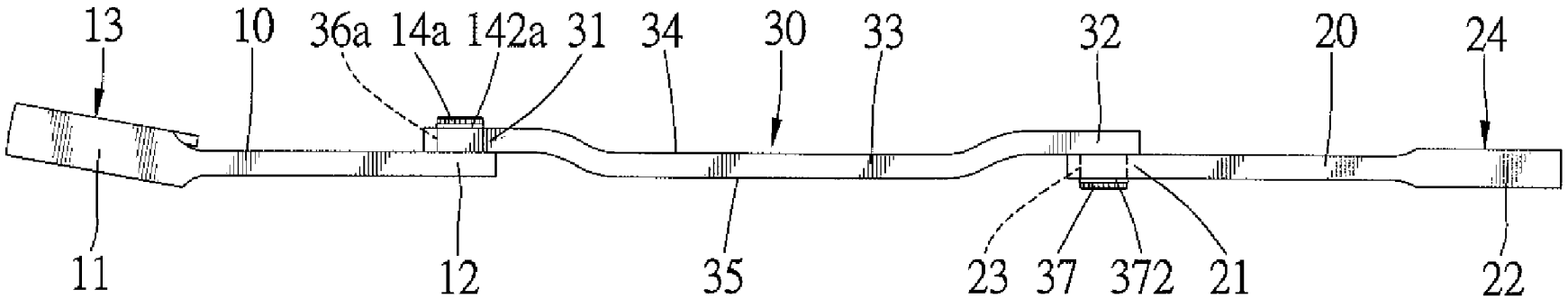
FIG. 9 is a side view of the wrench assembly of FIG. 8.

FIGS. 8 and 9 show a wrench assembly according to a third embodiment of the present invention. The third embodiment is like the first embodiment, except that the first wrench 10 includes a second driving device 14*a*, which is preferably a toothed stud defining an annular groove 141*a* for receiving a C-clip 142*a*. The bar 30 includes a first connecting devices 36*a*, which is preferably a box end.

Figure 10:
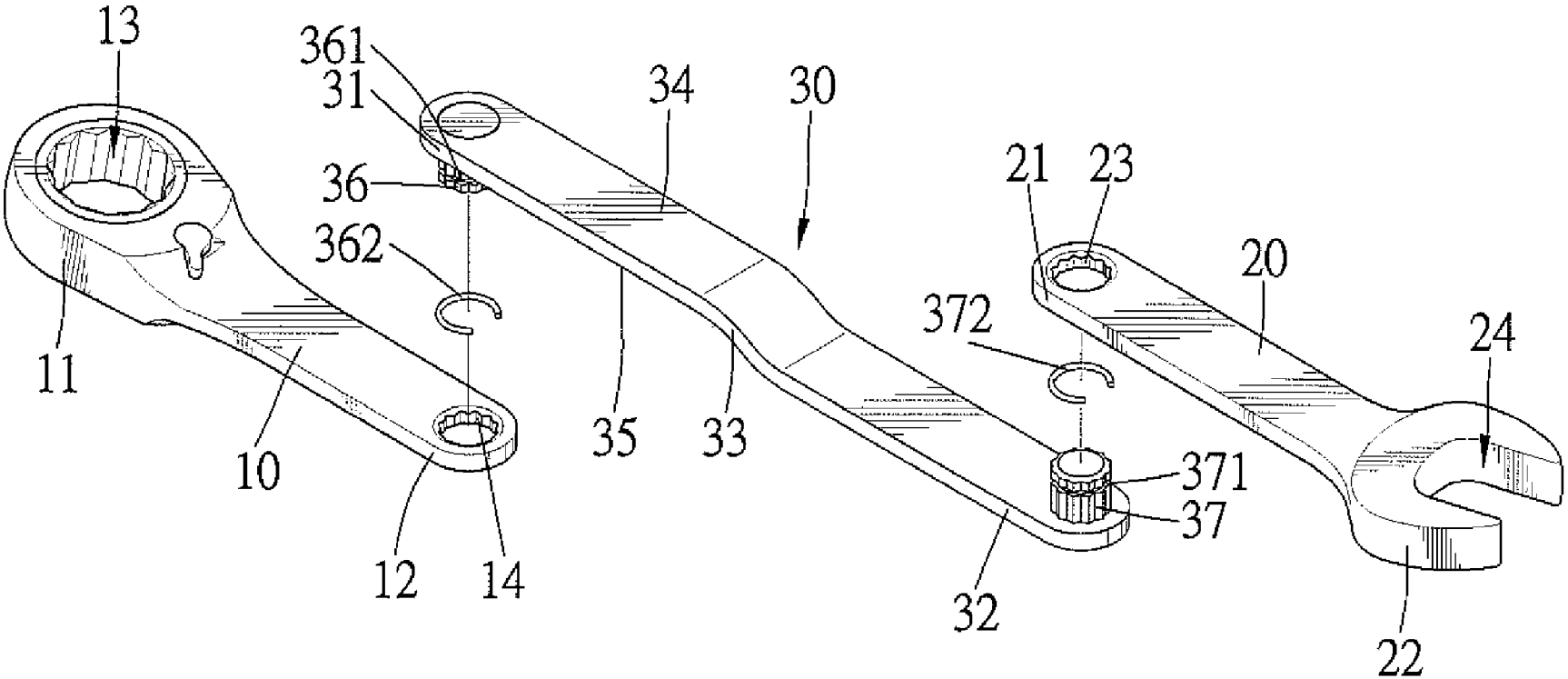
FIG. 10 is an exploded view of a wrench assembly according to a fourth embodiment of the present invention.
Figure 11:
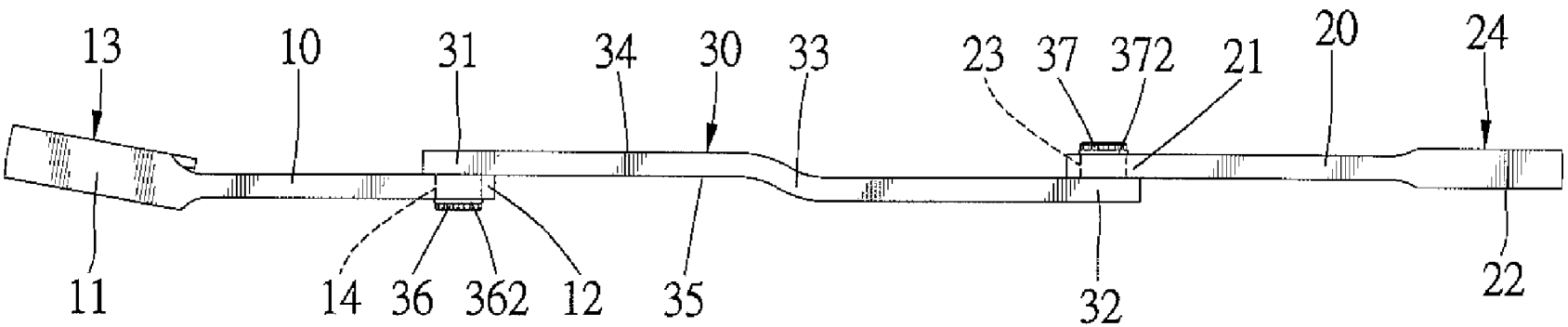
FIG. 11 is a side view of the wrench assembly of FIG. 10.

FIGS. 10 and 11 show a wrench assembly according to a fourth embodiment of the present invention. The fourth embodiment is like the first embodiment, except that the second connecting device 37 is on the upper surface 34 of the second end 32.

Therefore, in accordance with the aforementioned, the wrench assembly of the present invention exhibits several advantages. Firstly, the C-clips 362, 372, 142*a*, and 232*a* in the annular grooves 361, 371, 141*a*, and 231*a* ensure adequate connection of the first and second wrenches 10, 20 to the bar 30. Secondly, the wrench assembly is easily operable within a limited space. Thirdly, the C-clips 362, 372 are made of metal, and the annular grooves 361, 371 142*a*, and 232*a* are adapted to completely receive the C-clips 362, 372 142*a*, and 232*a*, and thereby ensure that the C-clips 362, 372 142*a*, and 232*a* have a long, useful life.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A wrench assembly comprising:

a first wrench comprising a first driving device at an end and a second driving device at an opposite end, with the second driving device of the first wrench having a thickness;

a second wrench comprising a first driving device at an end and a second driving device at an opposite end, with the first driving device of the second wrench having a thickness;

and a bar comprising a first connecting device for connection to the second driving device of the first wrench and a second connecting device for connection to the first driving device of the second wrench, with the first connecting device including a first annular groove spaced from the bar greater than the thickness of the second driving device of the first wrench, with the second connecting device including a second annular groove spaced from the bar greater than the thickness of the first driving device of the second wrench;

a first C-clip received in the first annular groove of the first connecting device, with the first C-clip and the bar located on opposite sides of the first wrench, with the first wrench being intermediate the first C-clip and the bar, with the first C-clip reinforcing connection of the first connecting device of the bar to the second driving device of the first wrench;

a second C-clip received in the second annular groove of the second connecting device, with the second C-clip and the bar located on opposite sides of the second wrench, with the second wrench being intermediate the second C-clip and the bar, with the second C-clip reinforcing connection of the second connecting device of the bar to the first driving device of the second wrench;

said first annular groove having a first depth into the first connecting device, with the first C-clip having an inner diameter and an outer diameter, with the first C-clip having undeformeable cross sectional profiles having a first extent parallel to the first depth when the first C-clip is received in the first annular groove, with the first depth being at least equal to or greater than the first extent such that the first C-clip is completely received by the first annular groove, with the first C-clip in an expanded condition received in the first annular groove and spaced from the first wrench having the outer diameter located outwardly of the first annular groove and the inner diameter located within the first annular groove, said first extent remaining the same due to said undeformeable cross sectional profiles when the first C-clip is completely received in the first annular groove and when the first C-clip is in the expanded condition; and said the second annular groove having a second depth into the second connecting device, with the second C-clip having an inner diameter and an outer diameter, with the second C-clip having undeformeable cross sectional profiles having a second extent parallel to the second depth when the second C-clip is received in the second annular groove, with the second depth being at least equal to or greater than the second extent such that the second C-clip is completely received by the second annular groove, with the second C-clip in an expanded condition received in the second annular groove and spaced from the second wrench having the outer diameter located outwardly of the second annular groove and the inner diameter located within the second annular groove said second extent remaining the same due to said undeformeable cross sectional profiles when the second C-clip is completely received in the second annular groove and when the second C-clip is in the expanded condition.

2. The wrench assembly according to claim 1 wherein the first C-clip is made of metal.

3. The wrench assembly according to claim 1 wherein the second C-clip is made of metal.

4. The wrench assembly according to claim 1 wherein the first C-clip comprises a circular cross-sectional profile.

5. The wrench assembly according to claim 1 wherein the second C-clip comprises a circular cross-sectional profile.

6. The wrench assembly according to claim 1 wherein the first connecting device of the bar comprises a toothed stud defining the first annular groove for receiving the first C-clip, wherein the second driving device of the first wrench comprises a box end for receiving the toothed stud of the bar.

7. The wrench assembly according to claim 6 wherein the second connecting device of the bar comprises a toothed stud defining the second annular groove for receiving the second C-clip, wherein the first driving device of the second wrench comprises a box end for receiving the toothed stud of the bar.

8. The wrench assembly according to claim 1 wherein the second connecting device of the bar comprises a toothed stud defining the second annular groove for receiving the second C-clip, wherein the first driving device of the second wrench comprises a box end for receiving the toothed stud of the bar.

9. The wrench assembly according to claim 1 wherein the first driving device of the first wrench is a selective one-way driving device.

10. The wrench assembly according to claim 1 wherein the second driving device of the second wrench is an open end.

11. The wrench assembly according to claim 1 wherein the bar comprises a middle section between the first and second connecting devices, wherein the middle section comprises an upper surface coinciding with a lower surface of the first connection device.

12. The wrench assembly according to claim 1 wherein the bar comprises a middle section between the first and second connecting devices, wherein the middle section comprises an upper surface coinciding with a lower surface of the second connection device.

13. The wrench assembly according to claim 1 wherein the bar comprises a middle section between the first and second connecting devices, wherein the middle section comprises an upper surface coinciding with lower surfaces of the first and second connection devices.

14. A wrench assembly comprising:

a first wrench comprising an end and an opposite end, with the end of the first wrench having a first driving device;

a second wrench comprising an end and an opposite end, with the end of the second wrench having a second driving device;

a bar comprising a first end and a second end;

a third driving device on one of the opposite end of the first wrench and the first end of the bar, with the third driving device having a first thickness;

a first connecting device connected to the third driving device, with the first connection device on another of the opposite end of the first wrench and the first end of the bar;

a fourth driving device on one of the opposite end of the second wrench and the second end of the bar, with the fourth driving device having a second thickness;

a second connecting device connected to the fourth driving device, with the second connecting device on another of the opposite end of the second wrench and the second end of the bar, with the first connecting device including a first annular groove spaced from the one of the opposite end of the first wrench and the first end of the bar greater than the first thickness of the third driving device, with the second connecting device including a second annular groove spaced from the one of the opposite end of the second wrench and the second end of the bar greater than the second thickness of the fourth driving device;

a first C-clip received in the first annular groove of the first connecting device, with the first C-clip and the one of the opposite end of the first wrench and the first end of the bar located on opposite sides of the other of the opposite end of the first wrench and the first end of the bar, with the other of the opposite end of the first wrench and the first end of the bar being intermediate the first C-clip and the one of the opposite end of the first wrench and the first end of the bar, with the first C-clip reinforcing connection of the first connecting device to the third driving device;

a second C-clip received in the second annular groove of the second connecting device, with the second C-clip and the one of the opposite end of the second wrench and the second end of the bar located on opposite sides of the other of the opposite end of the second wrench and the second end of the bar, with the other of the opposite end of the second wrench and the second end of the bar being intermediate the second C-clip and the one of the opposite end of the second wrench and the second end of the bar, with the second C-clip reinforcing connection of the second connecting device to the fourth driving device;

said first annular groove having a first depth into the first connecting device, with the first C-clip having an inner diameter and an outer diameter, with the first C-clip having undeformeable cross sectional profiles having a first extent parallel to the first depth when the first C-clip is received in the first annular groove, with the first depth being at least equal to or greater than the first extent such that the first C-clip is completely received by the first annular groove, with the first C-clip in an expanded condition received in the first annular groove and spaced from the first wrench having the outer diameter located outwardly of the first annular groove and the inner diameter located within the first annular groove, said first extent remaining the same due to said undeformeable cross sectional profiles when the first C-clip is completely received in the first annular groove and when the first C-clip is in the expanded condition; and said the second annular groove having a second depth into the second connecting device, with the second C-clip having an inner diameter and an outer diameter, with the second C-clip having undeformeable cross sectional profiles having a second extent parallel to the second depth when the second C-clip is received in the second annular groove, with the second depth being at least equal to or greater than the second extent such that the second C-clip is completely received by the second annular groove, with the second C-clip in an expanded condition received in the second annular groove and spaced from the second wrench having the outer diameter located outwardly of the second annular groove and the inner diameter located within the second annular groove said second extent remaining the same due to said undeformeable cross sectional profiles when the second C-clip is completely received in the second annular groove and when the second C-clip is in the expanded condition.

15. The wrench assembly according to claim 14 wherein the first C-clip is made of metal.

16. The wrench assembly according to claim 14 wherein the second C-clip is made of metal.

17. The wrench assembly according to claim 14 wherein the bar comprises a middle section between the first and second ends, wherein the middle section comprises an upper surface coinciding with a lower surface of the first connection device.

18. The wrench assembly according to claim 14 wherein the first C-clip comprises a circular cross-sectional profile.

19. The wrench assembly according to claim 14 wherein the second C-clip comprises a circular cross-sectional profile.

20. The wrench assembly according to claim 14 wherein the second connection device comprises a toothed stud defining the annular groove for receiving the second C-clip, wherein the fourth driving device comprises a box end for receiving the toothed stud of the second connection device.

21. The wrench assembly according to claim 14 wherein the first connection device comprises a toothed stud defining the first annular groove for receiving the first C-clip, wherein the third driving device comprises a box end for receiving the toothed stud of the first connection device.

22. The wrench assembly according to claim 21 wherein the second connection device comprises a toothed stud defining the second annular groove for receiving the second C-clip, wherein the fourth driving device comprises a box end for receiving the toothed stud of the second connection device.

* * * * *